US007511672B2

(12) United States Patent
Su et al.

(10) Patent No.: US 7,511,672 B2
(45) Date of Patent: Mar. 31, 2009

(54) ANTENNA FREQUENCY MODULATING EQUIPMENT

(75) Inventors: Wen-Fong Su, Tu-Cheng (TW); Lung-Sheng Tai, Tu-Cheng (TW); Po-Kang Ku, Tu-Cheng (TW); Yao-Shien Huang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/582,221

(22) Filed: Oct. 17, 2006

(65) Prior Publication Data

US 2007/0085745 A1 Apr. 19, 2007

(30) Foreign Application Priority Data

Oct. 17, 2005 (TW) ..... 94136102

(51) Int. Cl.
*H01Q 1/24* (2006.01)

(52) U.S. Cl. ..... 343/702; 343/745

(58) Field of Classification Search ..... 343/702, 343/745, 872

See application file for complete search history.

(56) References Cited

U.S. PATENT DOCUMENTS

| | | | | |
|---|---|---|---|---|
| 6,437,747 | B1 * | 8/2002 | Stoiljkovic et al. | 343/702 |
| 6,967,623 | B2 * | 11/2005 | Hirota | 343/702 |
| 2006/0001580 | A1 * | 1/2006 | Usui et al. | 343/702 |

* cited by examiner

*Primary Examiner*—Trinh V Dinh
*Assistant Examiner*—Dieu Hien T Duong
(74) *Attorney, Agent, or Firm*—Wei Te Chung

(57) ABSTRACT

A frequency modulating equipment (20) for being used in an antenna (10) for modulating frequency of the antenna (10) to achieve a desired operating frequency, comprises a slide block (30) attached to a radiating element (11) of the antenna (10) and being capable of moving freely and a plastic element (21). The slide block (30) comprises a contact portion (300) contacting a free end of the radiating element (11) of the antenna (10). The plastic element (21) is fixed onto the antenna (10). The slide block (30) is installed on the plastic element (21). The antenna (10) can achieve a desired operating frequency by moving the modulating befittingly the slide block (30).

5 Claims, 5 Drawing Sheets

ANTENNA FREQUENCY MODULATING EQUIPMENT

BACKGROUND OF THE INVENTION

1. Field of the Invention

The present invention relates generally to an antenna frequency modulating equipment, and more particularly to a PIFA (Planar Inverted-F Antenna) antenna or an H-shape antenna frequency modulating equipment.

2. Description of the Prior Art

With the development of wireless communication, more and more portable electronic devices, such as a notebook, install an antenna system for accessing to Internet. PIFA is a kind of minitype antenna usually used in portable electronic devices. PIFA is featured of compact size, light weight, small occupied space of the portable electronic device, low cost of manufacture, easy to achieve dual frequency bands or multi-bands, good impedance matching, and perfect horizontal polarization and vertical polarization.

It is well known, the radiating and receiving frequency of the antenna is proportional to the length of the radiating portion of the antenna. Designer can calculate the length of the radiating portion according to the working frequency before designing an antenna working at this frequency. However, the length of the radiating portion of the PIFA antenna from the mass production line has windage compared with the required length, and usually the actual length is longer than the required length. It leads to the radiating portion to appear the windage and thus, prevents the antenna from achieving a perfect working frequency. It also affects operating performance of the antenna. The worker must trim the length of the radiating portion of the antenna to desired length before installing the antenna into the notebook or other portable electronic device. On the other hand, the operating frequency of the antenna is infected by inner environment and structure of the notebook or other portable electronic device, so, a PIFA antenna design suitable for a notebook or other portable electronic device is difficult to be operated in another notebook without trimming. However, achieving perfect frequency by trimming the radiating portion of the antenna not only has lower efficiency but also easily makes the antenna become useless because of trimming excessively.

Hence, in this art, a frequency modulating equipment to overcome the above-mentioned disadvantages of the prior art will be described in detail in the following embodiment.

SUMMARY OF THE INVENTION

A primary object, therefore, of the present invention is to provide an antenna frequency modulating equipment for modulating radiating frequency of a PIFA antenna or an H-shape antenna.

In order to implement the above object and overcome the above-identified deficiencies in the prior art, the frequency modulating equipment adapted for being used in an antenna for modulating frequency of the antenna to achieve a desired operating frequency, comprises a slide block adapted for being attached to a radiating element of the antenna and being capable for moving freely, the slide block comprising a contact portion adapted for contacting a free end of the radiating element of the antenna; and a plastic element adapted for being fixed onto the antenna. The slide block is installed on the plastic element.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
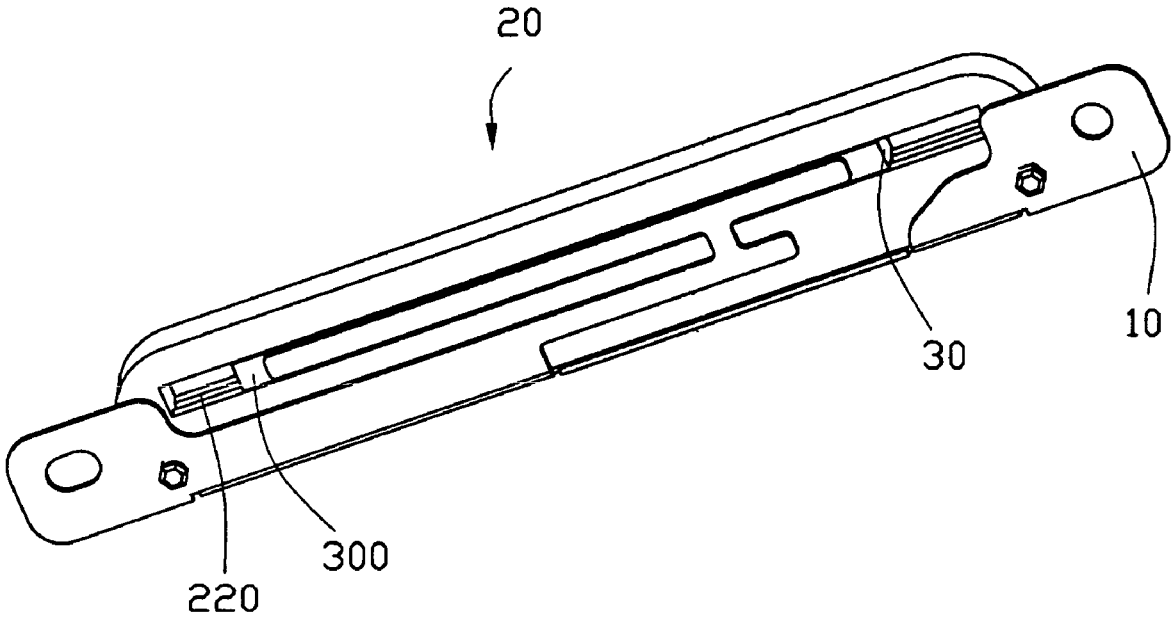
FIG. 1 is a perspective view of a frequency modulating element and an antenna being modulated in accordance with a first embodiment of the present invention.
Figure 2A:
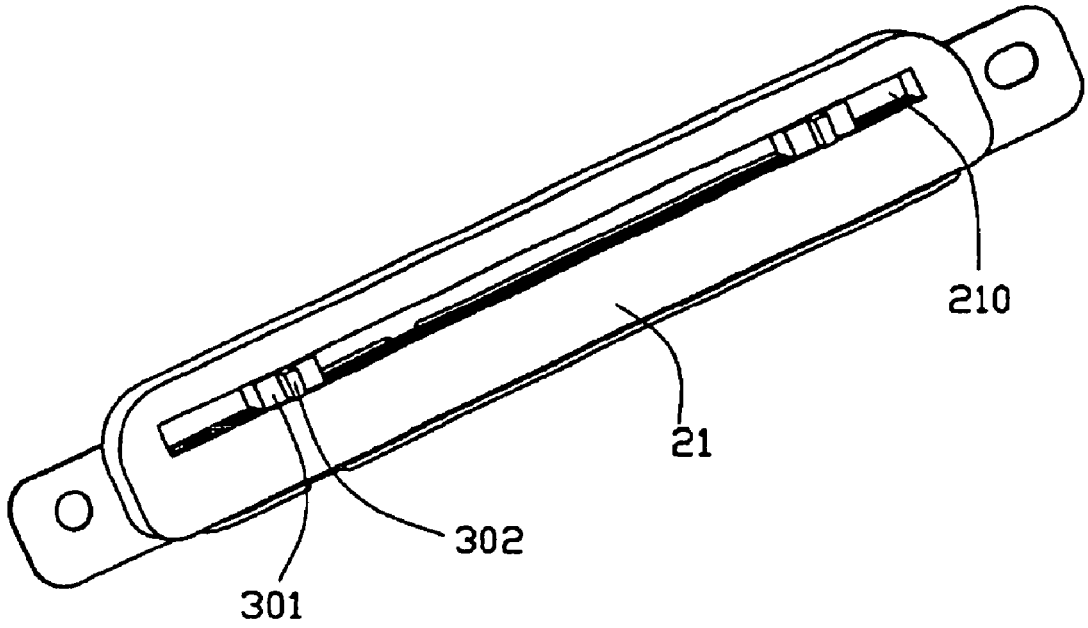
FIG. 2A is a perspective view similar to FIG. 1, but take from a different aspect.
Figure 2B:
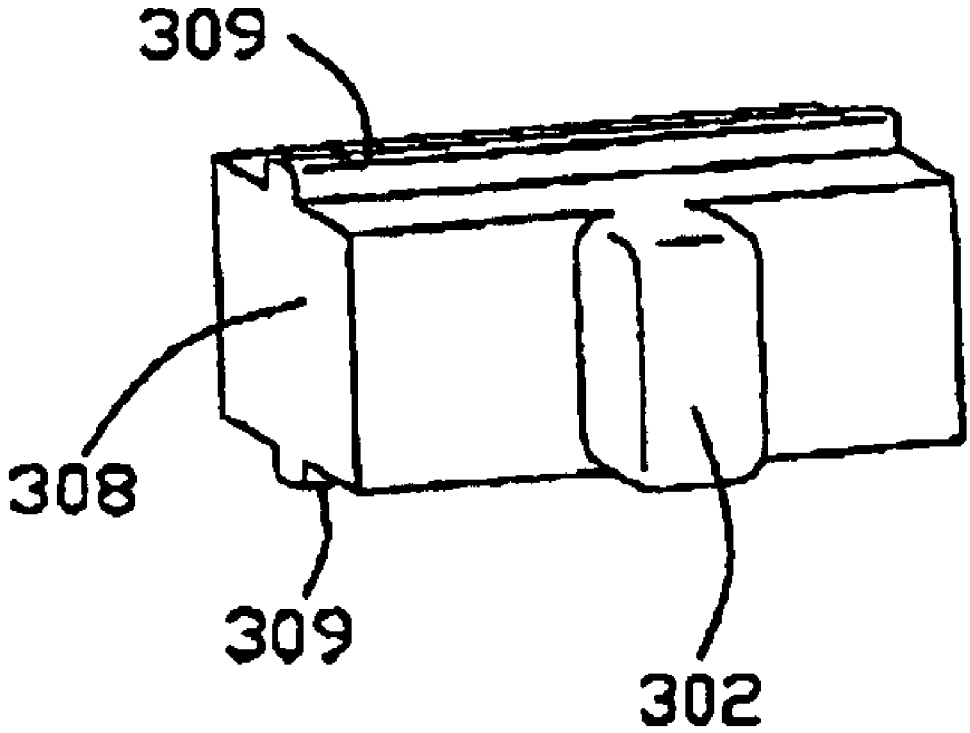
FIG. 2B is an enlarged view of a side block of the antenna modulating element.
Figure 3:
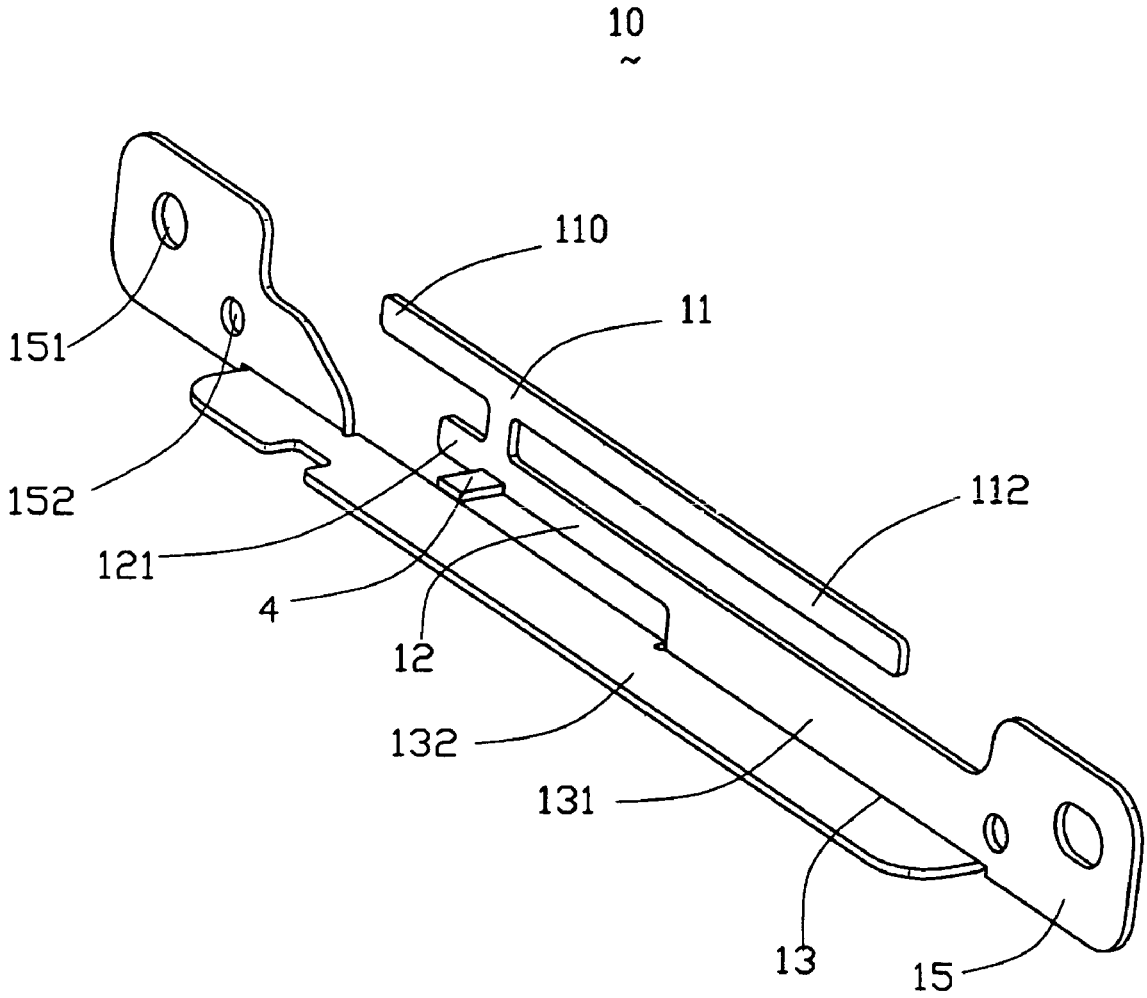
FIG. 3 is a perspective view of the antenna provided for being modulated in accordance with the present invention.

FIGS. 1 and 2 illustrate a first preferred embodiment of a frequency modulating element 20 of the present invention. In the first preferred embodiment, the antenna provided for being modulated is a dual-band Planar Inverted F Antenna (referring to FIG. 3) 10 including a radiating element 11, a grounding element 13, a connection element 12 connecting the radiating element 11 and the grounding element 13, a soldering element 4 for a feeding line and two fixing elements 15. The radiating element 11 comprises a short first element portion 110 and a long second element portion 112. The grounding element 13 comprises a vertical first grounding portion 131 coplanar with the radiating element 11 and a horizontal second grounding portion 132 perpendicular to the first grounding portion 131. The connection element 12 is inverted-T shape and is coplanar with the radiating element 11 and the first grounding portion 131. The soldering element 4 of the feeding line extends along a direction perpendicular to the plane of the connection element 12. The free end 121 of the connection element 12 also is a radiating element cooperating with the first radiating portion 110 to operate at the high frequency. The two fixing elements 15 extend respectively from the two ends of the grounding element 13. Each fixing element 15 has a large-size first hole 151 for installing the antenna 10 onto the notebook (not shown) and a small-size second hole 152 for installing the frequency modulating element 20 onto the antenna 10.

The frequency modulating element 20 of the present invention comprises two slide blocks 30 respectively contact terminals of the first radiating portion 110 and the second radiating portion 112, and a plastic element 21 fixed onto the fixing elements 15 and laid on the second grounding portion 132. The slide block 30 comprises a contact portion 300 contacting the first radiating portion 110 or the second portion 112 and an operating portion 301 formed integrally with the contact portion 300. The operating portion 301 comprises a main body 308 comprising a pair of protrudent ribs 309 respectively protruding from the up and down sides of the main body 308 and an extending portion 302 extending outwardly for operating the slide block 30. The plastic element 21 has a lengthways slot 210 correspond to the radiating element 11 of the antenna 10. A pair of narrow traces 220 respectively received from inner up and down sides of the lengthways slot 210 to receive the pair of protruding ribs 309 of the operating portion 301. The protruding ribs 309 are capable of sliding in the narrow trace 220. The slide block 30 is capable of sliding in the lengthways slot 210 along a longitudinal direction by operating the extending portion 302 of the operating portion 301.

The two slide blocks 30 are respectively attached to opposite free ends of the first radiating portion 110 and the second radiating portion 112 to increase the dielectric conductance of the environment around the antenna 10 because the dielectric conductance of the air is lower than the plastic material. The increased dielectric conductance of the environment around the antenna 10 alters the operating frequency of the antenna 10. The windage of the length of an fresh produced antenna is about of a few of millimeters comparing with the required antenna, so the antenna 10 can achieve a perfect operating frequency by modulating befittingly the slide block 30.

The antenna 10 of the first preferred embodiment may be any kind of PIFA antenna or H-shape antenna.

Figure 4:
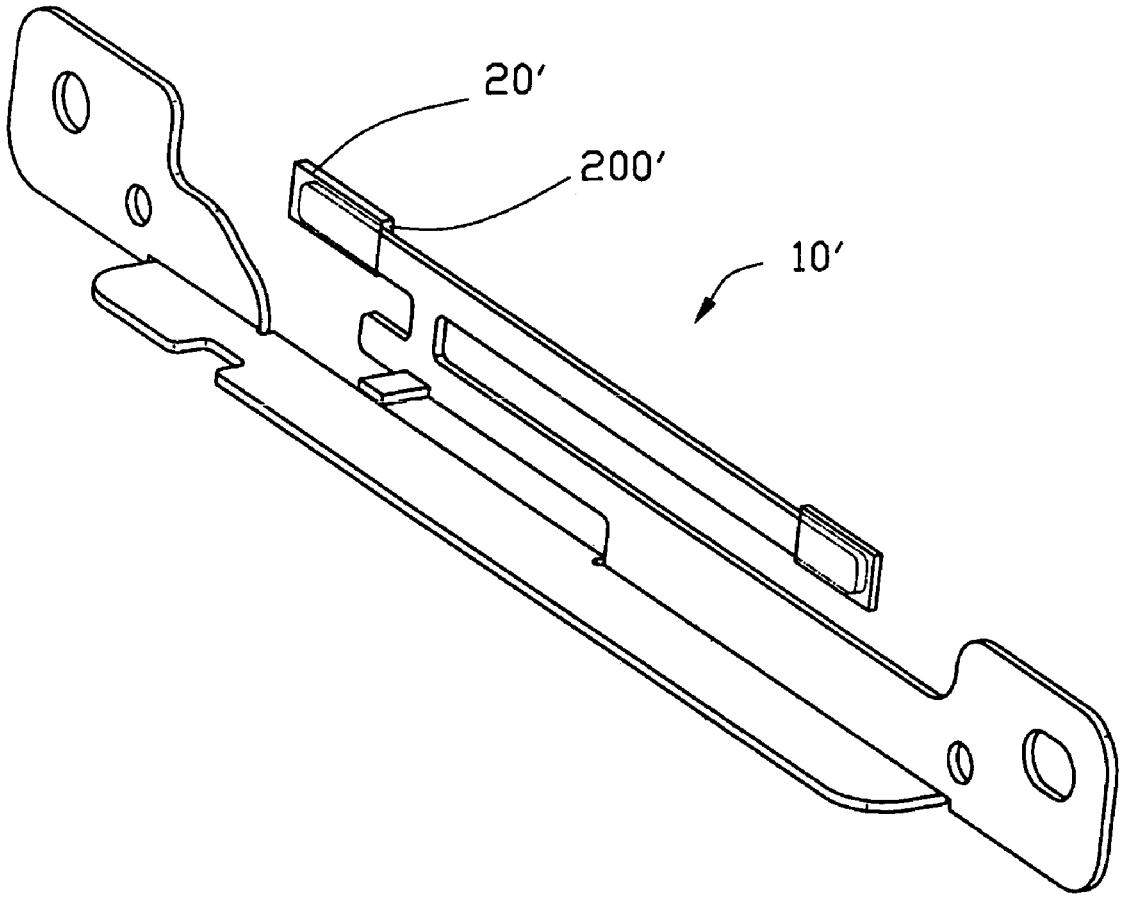
FIG. 4 is a perspective view of the frequency modulating element and an antenna being modulated in accordance with a second preferred embodiment of the present invention.

FIG. 4 illustrates a second preferred embodiment of a frequency modulating element 20' of the present invention. In this embodiment, the antenna provided for being modulated frequency is a PIFA Antenna 10' same as the antenna 10. The modulating element 20' is a pair of plastic rectangular sleeves, with opposite inner ends defining a pair of opens 200' opened toward each other. The free ends of the radiating element of the antenna 10' are inserted into the modulating element 20' through the opens 200'. so the modulating element 20' sheath the opposite ends of the radiating element of the antenna 10'. The operator may move the rectangular sleeves 20' to alter the length of the radiating element of the antenna 10' covered by the rectangular sleeves 20', so can change the operating frequency of the antenna 10' to achieve the purpose of modulating frequency.

The first and second preferred embodiments can achieve a common effect. The modulating element 20' of the second preferred embodiment also can add a plastic element 21 of the first preferred embodiment and can make a operating portion 301 extend from one side of the modulating element 20' for expediently and accurately achieving modulating and escaping the modulating element 20' falling from the radiating element of the antenna.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A frequency modulating equipment adapted for being used in an antenna including at least one radiating element for modulating frequency of the antenna to achieve a desired operating frequency, comprising:

a slide block attached to and without detaching away from the radiating element of the antenna, the slide block comprising a contact portion adapted for contacting a free end of the radiating element of the antenna; and a plastic element adapted for being fixed onto the antenna; and wherein the slide block is installed on the plastic element; wherein the slide block has an operating portion formed integrally with the contact portion for moving the contract portion expediently; wherein the operating portion comprises a main body having two protruding ribs protruding from the up and down sides of the main body and an extending portion extending outwardly for operating the slide block.

2. The frequency modulating equipment as claimed in claim 1, wherein the antenna ready for modulation is a Planar Inverted-F Antenna or an H-shape Antenna, and comprising a radiating element, a grounding element, and two fixing elements.

3. The frequency modulating equipment as claimed in claim 1, wherein the plastic element is fixed on the fixing elements.

4. The frequency modulating equipment as claimed in claim 1, wherein the plastic element has a lengthways slot to receive the slide block and wherein the slide block is capable of moving in the lengthways slot.

5. The frequency modulating equipment as claimed in claim 4, wherein a pair of narrow traces respectively received from inner up and down sides of the lengthways slot to receive the pair of protruding ribs of the operating portion.

* * * * *